United States Patent [19]

Van Kessel

[11] Patent Number: 4,808,847

[45] Date of Patent: Feb. 28, 1989

[54] TEMPERATURE-COMPENSATED VOLTAGE DRIVER CIRCUIT FOR A CURRENT SOURCE ARRANGEMENT

[75] Inventor: Henricus J. Van Kessel, Son, Netherlands

[73] Assignee: U.S. Philips Corporation, New York, N.Y.

[21] Appl. No.: 208,852

[22] Filed: Jun. 10, 1988

Related U.S. Application Data

[63] Continuation of Ser. No. 9,429, Feb. 2, 1987, abandoned.

[30] Foreign Application Priority Data

Feb. 10, 1986 [NL] Netherlands ..... 8600306

[51] Int. Cl.[4] ..... G05F 1/567

[52] U.S. Cl. ..... 307/297; 307/310; 323/315; 323/907; 330/288; 330/289

[58] Field of Search ..... 307/200 B, 296 R, 297, 307/310; 323/315–316, 907; 330/288, 289

[56] References Cited

U.S. PATENT DOCUMENTS

| | | | |
|---|---|---|---|
| 4,004,164 | 1/1977 | Cranford, Jr. et al. | 307/362 |
| 4,010,425 | 3/1977 | Dingwall et al. | 307/297 X |
| 4,199,693 | 4/1980 | Bennett | 307/297 X |
| 4,301,380 | 11/1981 | Thomas | 307/297 X |
| 4,583,037 | 4/1986 | Sooch | 330/288 X |
| 4,609,833 | 9/1986 | Guterman | 307/297 |
| 4,618,815 | 10/1986 | Swanson | 330/288 |
| 4,645,948 | 2/1987 | Morris et al. | 323/907 X |
| 4,760,288 | 7/1988 | Peczalski | 307/310 X |
| 4,768,170 | 8/1988 | Hoff | 307/310 X |

OTHER PUBLICATIONS

Micro Electronic Journal, vol. 14, No. 4, "A Simple NMOS Constant Voltage and Current Source", by R. Haskard, 1983, pp. 31–37.

*Primary Examiner*—David Hudspeth
*Attorney, Agent, or Firm*—Steven R. Biren

[57] ABSTRACT

A current source circuit comprises a first enhancement mode field effect transistor arranged as a current source. A drive voltage which is generated by a second depletion mode field effect transistor and a third depletion mode field effect transistor is applied to the drive electrode of this first transistor. The drive voltage is such that the output current of the first transistor is substantially independent of temperature variations.

9 Claims, 2 Drawing Sheets

TEMPERATURE-COMPENSATED VOLTAGE DRIVER CIRCUIT FOR A CURRENT SOURCE ARRANGEMENT

This is a continuation of application Ser. No. 009,429, filed Feb. 2, 1987, now abandoned.

BACKGROUND OF THE INVENTION

The invention relates to a circuit arrangement for supplying a drive voltage to an enhancement mode field effect transistor arranged as a current source whose channel is included between a first supply voltage terminal and an output terminal, said circuit arrangement comprising:

a first depletion mode field effect transistor operated in the non-saturated mode whose channel is included between the first supply voltage terminal and a junction point, a second depletion mode field effect transistor operated in the saturated mode whose channel is included between the said junction point and a second supply voltage terminal, the drive voltage for the current source field effect transistor being supplied from the said junction point to the gate of the current source field effect transistor.

A circuit arrangement of this type is known from U.S. Pat. No. 4,004,164. In this known circuit arrangement the gate of the first field effect transistor is connected to a reference voltage, for example a voltage at ground level, and the gate of the second field effect transistor is connected to the said junction point. With an appropriate choice of the parameters the field effect transistor arranged as a current source will supply a current which varies inversely with changes in the supply voltage in order to supply a compensated current to an analogous circuit.

It is not an object of the present application to supply a compensated current, but rather to provide a circuit arrangement for supplying a drive voltage to an enhancement mode field effect transistor arranged as a current source, which field effect transistor, with this drive voltage, supplies a current which is independent of temperature variations to a great extent.

SUMMARY OF THE INVENTION

To this end a circuit arrangement of the type defined above is characterized in that the gate of the first field effect transistor is connected to the said junction point, in that the gate of the second field effect transistor is connected to the first supply voltage terminal and in that the channel width/channel length ratios $k_1$ and $k_2$, respectively of the first and second field effect transistors and the threshold voltages $V_{TD}$ thereof are chosen to be such that at the desired current intensity supplied by the current source the temperature-dependent variation of the gate-source voltage of the first transistor, at least within a predetermined temperature range, at least substantially corresponds to the temperature-dependent variation required of the source-gate voltage of the field effect transistor arranged as a current source.

The circuit arrangement of which the output current is to be maintained substantially constant may be formed in such a manner that the channel width/channel length ratios $k_1$ and $k_2$, of the first and second transistors respectively, and the threshold voltages $V_{TD}$ thereof, as well as the threshold voltage $V_{TE}$ of the field effect transistor arranged as a current source are chosen to be such that at a given reference temperature $T_0$ the following equation is at least substantially satisfied:

$$\frac{(k_1 + k_2) - \sqrt{k_1(k_1 + 3k_2)}}{k_2 - k_1} = \frac{V_{TE}(T_0) + \frac{4}{3}\left|\frac{dV_{TE}}{dT}\right| \cdot T_0}{|V_{TD}(T_0)| - \frac{4}{3}\left|\frac{dV_{TD}}{dT}\right| \cdot T_0}.$$

Thus it can be achieved that the derivative with respect to temperature of the current supplied by the current source transistor is equal to zero at the reference temperature $T_0$ while this at least approximately also applies within a very broad temperature range around $T_0$.

Furthermore, the channel width/channel length ratio of the second field effect transistor relative to the channel width/channel length ratio of the first field effect transistor is preferably chosen to be relatively large. It is then achieved that the influence of the spread in width/length ratios of the channels of the transistors caused by the manufacturing process is greatly reduced.

Furthermore it is an object of the invention to provide a circuit arrangement for supplying a drive voltage to an enhancement mode field effect transistor arranged as a current source, which field effect transistor supplies a current which is also independent of supply voltage variations to a great extent.

In a circuit arrangement of the type defined in the opening paragraph this object can be satisfied if the channel of a fourth depletion mode field effect transistor operated in the saturated mode is included between the second supply voltage terminal and the channel of the second transistor, the gate of said fourth field effect transistor being connected to the said junction point.

It is to be noted that U.S. Pat. No. 4,031,456 describes a current source circuit provided with an enhancement mode field effect transistor operated in the non-saturated mode whose channel is included between a first supply voltage terminal and a junction point, a second depletion mode field effect transistor whose channel is included between the said junction point and the output terminal of the circuit arrangement, while the gate of this second field effect transistor is connected to the first supply voltage terminal, and a depletion mode field effect transistor arranged as a current source whose channel is included between the first supply voltage terminal and an output terminal.

However, in this known circuit arrangement the first field effect transistor is of the enhancement type and not of the depletion type as in the present Application, and furthermore the current source transistor is of the depletion type and not of the enhancement type as in the present Application. Moreover, the channel of the second field effect transistor is not connected to the first supply voltage terminal but is connected to the output terminal of the circuit arrangement, which implies that there is no question of a separate drive circuit for applying a drive voltage to one or more field effect transistors arranged as a current source, but of a circuit arrangement functioning as a current source in its totality. This publication only states that the second field effect transistor is to operate in region with a positive temperature characteristic or that the first field effect transistor is to operate in a region with a negative temperature characteristic.

BRIEF DESCRIPTION OF THE DRAWING

The invention will be described in greater detail with reference to the accompanying FIGS.

DESCRIPTION OF THE PREFERRED EMBODIMENTS

Figure 1A:
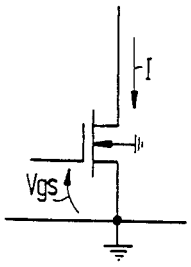
FIG. 1*a* shows an enhancement mode field effect transistor arranged as a current source and FIG. 1*b* the associated I–$V_{gs}$ characteristic curve.
Figure 1B:
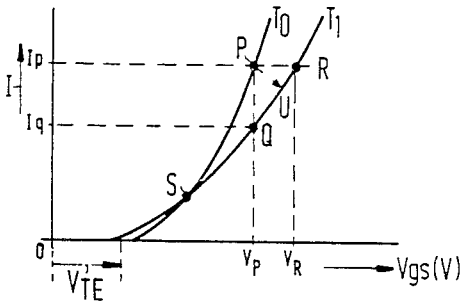

FIG. 1 diagrammatically shows an enhancement mode field effect transistor functioning as a current source, together with its I–$V_{gs}$ characteristic curve. The index E will be used hereinafter for a number of parameters relating to this type of transistor). In this characteristic curve the variation of the current I is plotted as a function of the gate voltage $V_{gs}$ for two temperatures $T_0$ and $T_1$, where $T_1 > T_0$. The transistor operates in the region above the point of intersection S, thus for example is set at the point P. When the temperature is raised from $T_0$ to $T_1$, neither the voltage $V_{gs}$ nor the current I will generally remain constant, but the transistor will be set at a point on the curve for $T_1$ somewhere between the points Q and R, for example at the point U.

However, a current source which is to supply a constant current is required to maintain the supplied current I also when the temperature varies. For a current I through an enhancement mode transistor operating in the saturated mode it applies that $$I = k(V_{gs} - V_{TE})^2 \tag{1}$$

with $$k = \mu_E \frac{C_{ox}}{2} \cdot \frac{W}{L} \tag{2}$$

where $\mu_E$ = the mobility of the charge carriers in the channel;

$C_{ox}$ = the capacitance of the oxide under the gate per unit of surface area;

W = the effective channel width;

L = the effective channel length;

$V_{TE}$ = the threshold voltage of the transistor used.

When it is assumed that: $\mu_o$ = the mobility of the charge carriers at the temperature $T = T_0$, the above quoted formula (1) may be written as $$V_{gs} - V_{TE} = \sqrt{\frac{2I.L}{\mu_0 C_{ox} W}} \cdot \sqrt{\frac{\mu_0}{\mu_E}} \tag{3}$$

If the voltage $V_{gs}$ can be changed as a function of the temperature in such a manner that the current I remains constant, formula (3) can be written as:

$$V_{gs} - V_{TE} = C^x \sqrt{\frac{\mu_0}{\mu_E}} \tag{4}$$

where $C^x$ is a constant. A generally used expression for the mobility of the charge carriers in the channel is:

$$\mu_E(T) = \mu_0 \left(\frac{T_0}{T}\right)^{3/2} \tag{5}$$

which after substitution in (4) leads to:

$$V_{gs} = V_{TE} + C^x \left(\frac{T}{T_0}\right)^{\frac{3}{4}} \tag{6}$$

Figure 2:
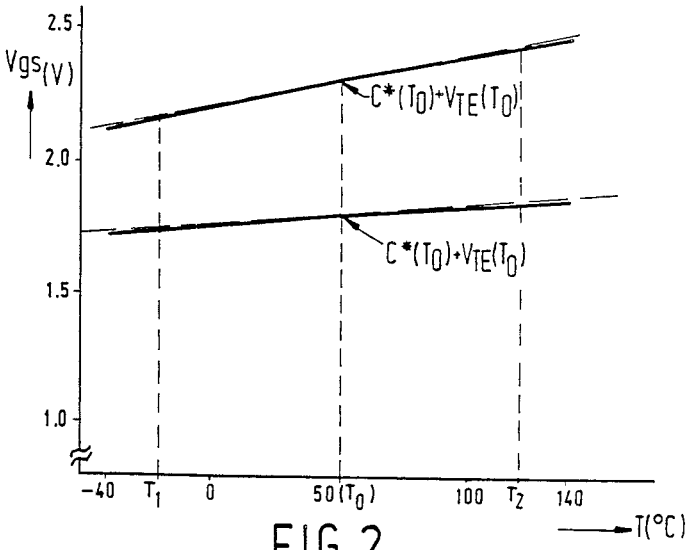
FIG. 2 shows the relationship between the output current I and the drive voltage $V_{gs}$ of FIG. 1 for two different temperatures.

In FIG. 2 two values of $C^x$ are chosen for the temperature $T_0 = 323$ K. (50° C.), namely 1.0 and 1.5 volts. Subsequently the gate voltage $V_{gs}$ is plotted with reference to formula (6) as a function of the temperature for the temperature range 233 K. < T < 413 K. (−40° C. < T < 140° C.) FIG. 2 shows that $V_{gs}$ varies substantially linearly with the temperature over a relatively large temperature range. For the purpose of comparison the straight curve is drawn as a broken line along-side both curves, which line makes it clear that the deviation from the straight curve is only very small. The slope of the two substantially straight lines is given by:

$$\frac{\delta V_{gs}}{\delta T} = \frac{dV_{TE}}{dT} \quad \frac{3}{4} \quad \frac{C^x}{T_0^{\frac{3}{4}}} \cdot T^{-\frac{1}{4}} \tag{7}$$

Since $V_{TE}$ decreases linearly when the temperature increases, the derivative with respect to temperature of this threshold voltage is a constant. The slope of the curves in FIG. 2 at a temperature $T = T_0$ is thus exclusively determined by the value of $C^x$.

Figure 3:
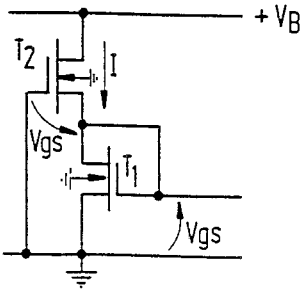
FIG. 3 shows first example of a drive circuit according to the invention.

The invention aims to provide a circuit arrangement whose output voltage satisfies the function given in formula (6) at least with a very good approximation. A first embodiment of this circuit arrangement is shown in FIG. 3. When this circuit arrangement is coupled to the current source transistor of FIG. 1, this transistor will supply a current I which is substantially independent of the temperature.

The circuit arrangement of FIG. 3 is provided with the field effect transistors $T_1$ and $T_2$ which are both of the depletion type. (The index D will be used hereinafter for a number of parameters relating to this type of transistor). The channels of the two transistors are series-arranged in the manner shown between the supply voltage terminal $+V_B$ and the ground terminal. The junction point between the two channels is connected to the gate of transistor $T_1$ and the gate of transistor $T_2$ is connected to the ground terminal. Transistor $T_1$ operates in the triode region or non-saturated mode, while transistor $T_2$ operates in the saturated mode. For the current I through the two transistors it applies at least approximately:

$$I=k_2(-V_{gs}-V_{TD})^2=k_1V_{gs}(V_{gs}-2V_{TD}) \quad (8)$$

with $$k_1=\mu_D\frac{C_{ox}}{2}\frac{W_1}{L_1} \text{ and } k_2=\mu_D\frac{C_{ox}}{2}\frac{W_2}{L_2}$$

An expression for $V_{gs}$ can be derived from this relation:

$$V_{gs}=\frac{(k_1+k_2)-\sqrt{k_1(k_1+3k_2)}}{k_2-k_1}\cdot|V_{TD}|=f(k_1k_2)\cdot|V_{TD}| \quad (9)$$

Figure 4:
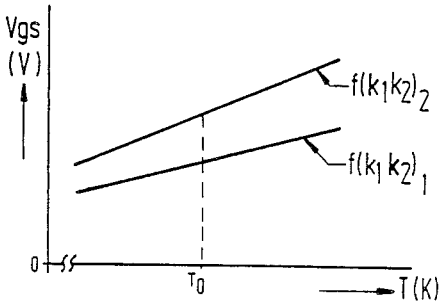
FIG. 4 illustrates the dependence of the drive voltage $V_{gs}$ on the temperature required if the output current is not to vary with temperature.

In formula (9) $f(k_1k_2)$ is a positive factor which is independent of the temperature T and whose magnitude is determined by the W/L ratios of the two transistors. FIG. 4 diagrammatically shows the variation of the voltage $V_{gs}$ as a function of the temperature for two values of $f(k_1k_2)$. The slope of the two substantially linear curves is given by:

$$\frac{\delta V_{gs}}{\delta T}=f(k_1k_2)\cdot\left|\frac{dV_{TD}}{dT}\right| \quad (10)$$

in which the derivative of the threshold voltage $V_{TD}$ with respect to the temperature is a positive constant, which means that the slope of the curves is determined by the W/L ratios of the two transistors.

It will be evident that by correct choice of the effective channel length L and the effective channel width W of the two transistors T1 and T2 the curve for $V_{gs}$ in FIG. 4, at least at a chosen reference temperature $T_0$, passes through the same point as the corresponding curve for the current source transistor shown in FIG. 2, while the slope of the curve of FIG. 4 can also be chosen to be such that the curves of FIGS. 2 and 4 coincide or substantially coincide over a broad temperature range.

Based on the above-quoted formulas it is possible to derive a relation which the W/L ratios must satisfy if the curves of FIGS. 2 and 4 are coincide at least one point.

When formula (9) is substituted in formula (6), we find for $C^x$:

$$C^x=(V_{gs}-V_{TE})T=T_0=f(k_1k_2)\cdot|V_{TD}(T_0)|-V_{TE}(T_0) \quad (11)$$

Substituting formula (10) in formula (7) yields at the temperature $T=T_0$:

$$f(k_1k_2)\cdot\left|\frac{dV_{TD}}{dT}\right|=\frac{dV_{TE}}{dT}+\frac{3}{4}\frac{C^x}{T_0} \quad (12)$$

Combination of these last two formulas (11) and (12) yields the condition which the respective channel lengths and widths of the transistors T1 and T2 are to satisfy at a given reference temperature $T=T_0$ if at this temperature the derivative with respect to temperature of the supplied current is to be equal to zero, in other words at least around this temperature the current is to be independent of the temperature. This condition is:

$$f(k_1k_2)=\frac{V_{TE}(T_0)+\frac{4}{3}\left|\frac{dV_{TE}}{dT}\right|\cdot T_0}{|V_{TD}(T_0)|-\frac{4}{3}\left|\frac{dV_{TD}}{dT}\right|\cdot T_0} \quad (13)$$

Since $f(k_1k_2)$ as a function of $k_1$ and $k_2$ is only dependent on the W/L ratios of the relevant transistors, it is only necessary for achieving the required temperature-dependent drive voltage that the width/length ratios of the channels of each transistor are chosen to be such that the above-mentioned formula is satisfied. With such a choice the derivative with respect to temperature of the current through the current source transistor is zero at $T=T_0$ and at least substantially 0 for a large range around $T=T_0$.

Figure 5:
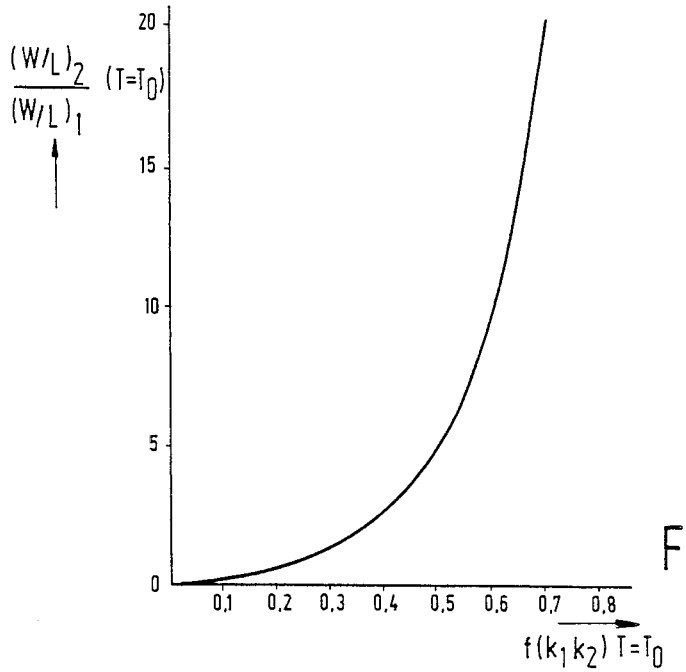
FIG. 5 shows a graph indicating how a beneficial choice can be made for the width/length ratios of the channels of the various transistors of a drive circuit according to the invention.

In FIG. 5 $f(k_1k_2)$ is plotted as a function of $(W/L)_2/(W/L)_1$ (at $T=T_0$). This Figure shows that the variation in $f(k_1k_2)$ becomes increasingly smaller as the ratio $(W/L)_2/(W/L)_1$ becomes larger. In other words, any spread in the (W/L) ratios will have less and less influence on the variation of the current supplied by the current source transistor as a function of the temperature as the value of $f(k_1k_2)$ is larger. It is therefore to be preferred to choose the value of $f(k_1k_2)$ as large as possible within the limitations imposed by possible different design requirements.

Figure 6:
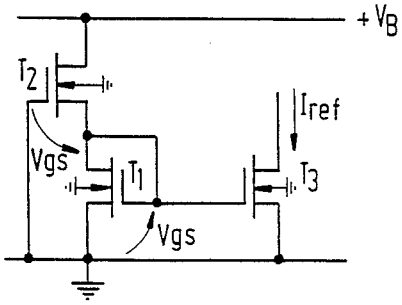
FIG. 6 shows a complete circuit arrangement for supplying a constant temperature-independent reference current $I_{ref}$.

The total current source circuit consisting of a combination of the circuits of FIGS. 1 and 3 is shown in FIG. 6. The current $I_{ref}$ supplied by this circuit is dependent on the choice of the channel length and channel width of the current source transistor $T_3$ as is apparent from the above-quoted formulas (1) and (2).

Figure 7:
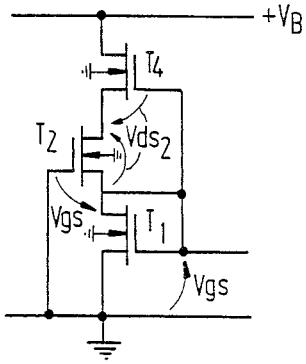
FIG. 7 shows a second example of a drive circuit according to the invention.

FIG. 7 shows a more extensive drive circuit according to the invention in which a fourth depletion-mode transistor $T_4$ is incorporated in such a manner that the channel of this transistor is arranged between the supply voltage terminal and the channel of the second transistor, while the gate of the fourth transistor is connected to the gate of the first transistor. By addition of this transistor $T_4$ it is achieved that the drive voltage supplied by the circuit arrangement (and hence the current supplied by the current source transistor) becomes independent of supply voltage variations to a great extent.

The added fourth transistor operates in the saturated mode. The minimum supply voltage required in the circuit of FIG. 7 is given by:

$$V_B>V_{gs}+|V_{TD}| \quad (13)$$

Furthermore the supply voltage is to be chosen sufficiently high (with the limitation that the transistor $T_4$ is saturated). It is apparent from the foregoing that transistor $T_2$ must also be saturated. This implies that $$-V_{gs}+|V_{TD}|<V_{ds2}<|V_{TD}| \quad (14)$$

must apply to transistor $T_2$. The voltage $V_{ds2}$ must satisfy the two conditions, on the one hand to keep the transistor $T_2$ saturated and on the other hand to ensure that transistor $T_4$ is not pinched off. It follows, from a calculation that if transistors $T_1$, $T_2$ and $T_4$ have different (W/L) ratios, indicated by $k_1$, $k_2$ and $k_4$, respectively, it must apply that $$f(k_1k_2) > \frac{2k_1}{k_4 - k_1}; \quad (16)$$

however, if the transistors $T_2$ and $T_3$ have the same (W/L) ratio we find that $$k_2 = k_4 > 5k_1 \quad (17)$$

or $$(W/L)_2 = (W/L)_4 > 5(W/L)_1. \quad (18)$$

It has been found that the circuit of FIG. 7 supplies a drive voltage $V_{gs}$ which is substantially independent of supply voltage variations. As compared with the circuit of FIG. 3 an improvement by a factor of 10 was achieved in a practical embodiment. A practical value for the derivative of the voltage $V_{gs}$ with respect to the supply voltage is $$\frac{V_{gs}}{V_B} \cong 1 \text{ mV/V} \quad (19)$$

A further improvement in the independence of the supply voltage variations of the current supplied by the current source transistor may be achieved by connection of a further depletion mode transistor $T_5$ operating in the saturated mode to the current source transistor.

Figure 8:
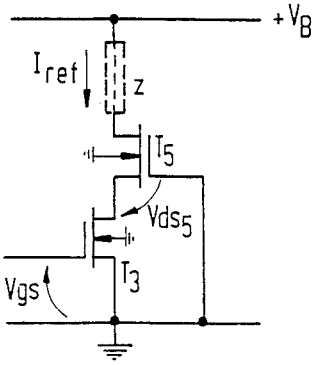
FIG. 8 shows a more elaborate known current source circuit with which a current can be supplied which is independent of supply voltage variations to a great extent.

FIG. 8 shows a current source circuit in which the channel of the transistor $T_5$ is arranged in series with the channel of the current source transistor $T_3$. The gate of transistor $T_5$ is connected to ground. The electronic circuit to which the current is to be applied and which is generally indicated by Z is present between the supply voltage terminal $+V_B$ and the channel of transistor $T_5$.

A current source circuit of this type is known from British patent Application No. 2,054,996.

Figure 9:
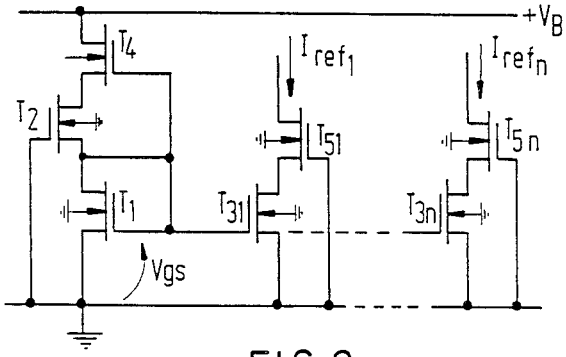
FIG. 9 shows a circuit arrangement for supplying a plurality of constant temperature-independent currents, comprising a plurality of current source circuits which are parallel-driven by a drive circuit according to the invention.

Finally FIG. 9 shows a complete circuit arrangement consisting of a drive stage provided with the transistors $T_1$, $T_2$ and $T_4$ and a number of current source circuits consisting of the transistors $T_{31}$, $T_{51}$ . . . $T_{3n}$, $T_{5n}$. The drive stage is identical to the circuit of FIG. 7 and the current source circuits are identical to the circuit of FIG. 8. The currents $I_{ref1}$ . . . $I_{refn}$ which are supplied by the various current source circuits can be set by correct choice of the respective width/length ratios (W/L) of the channels of the respective transistors $T_{31}$ . . . $T_{3n}$.

What is claimed is:

1. A circuit arrangement for supplying a drive voltage to an enhancement mode field effect transistor having a gate electrode and coupled as a current source whose channel is coupled between a first supply voltage terminal and an output terminal, said circuit arrangement comprising:

a first depletion mode field effect transistor having a gate electrode and operated in the non-saturated mode, whose channel is coupled between the first supply voltage terminal and a junction point; and a second depletion mode field effect transistor having a gate electrode and operated in the saturated mode, whose channel is coupled between said junction point and a second supply voltage terminal, drive voltage for the current source field effect transistor being supplied from said junction point to the gate of the current source field effect transistor, the gate of the first field effect transistor being connected to said junction point, the gate of the second field effect transistor being connected to the first supply voltage terminal, and the channel width/channel length ratios $k_1$ and $k_2$ of the first and second field effect transistors respectively and threshold voltages $V_{TD}$ thereof being chosen to be such that, at the desired current supplied by the current source, the temperature-dependent variation of the gate-source voltage of the first transistor, at least within a selected temperature range, substantially corresponds to the temperature-dependent variation required of the source-gate voltage of the current source field effect transistor for the output current thereof to be maintained substantially constant.

2. A circuit arrangement as claimed in claim 1, characterized in that the channel width/channel length ratios $k_1$ and $k_2$ of the first and second transistors respectively and the threshold voltages $V_{TD}$ thereof as well as the threshold voltage $V_{TE}$ of the current source field effect transistor are chosen to be such that at a given reference temperature $T_0$ the following equation is at least substantially satisfied:

$$\frac{(k_1 + k_2) - \sqrt{k_1(k_1 + 3k_2)}}{k_2 - k_1} = \frac{V_{TE}(T_0) + \frac{4}{3}\left|\frac{dV_{TE}}{dT}\right| \cdot T_0}{|V_{TD}(T_0)| - \frac{4}{3}\left|\frac{dV_{TD}}{dT}\right| \cdot T_0}.$$

3. A circuit arrangement as claimed in claim 1 or 2, characterized in that the channel width/channel length ratio of the second field effect transistor relative to the channel width/channel length ratio of the first field effect transistor is chosen to be relatively large.

4. A circuit arrangement as claimed in claim 1 or 2, further comprising a fourth depletion mode field effect transistor having a channel and a gate, characterized in that the channel of said fourth depletion mode field effect transistor, operated in the saturated mode, is coupled between the second supply voltage terminal and the channel of the second transistor, the gate of said fourth field effect transistor being connected to said junction point.

5. An arrangement for supplying a plurality of constant currents to a corresponding number of loads, comprising a corresponding number of enhancement mode field effect transistors coupled as current source whose channels are each connected between the first supply voltage terminal and one of a corresponding number of output terminals, said arrangement comprising a single circuit as claimed in claim 1 or 2 for supplying a drive voltage to each current source field effect transistor.

6. A circuit arrangement for supplying a constant current to a load, comprising an enhancement mode field effect transistor having a gate electrode and coupled as a current source whose channel is coupled between a first supply voltage terminal and an output terminal, and a circuit arrangement for supplying a drive voltage to said current source field effect transistor, said circuit arrangement comprising:

a first depletion mode field effect transistor having a gate electrode and operated in the non-saturated mode whose channel is coupled between the first supply voltage terminal and a junction point; and a second depletion mode field effect transistor having a gate electrode and operated in the saturated mode whose channel is coupled between said junction point and a second supply voltage terminal, drive voltage for the current source field effect transistor being supplied from said junction to the gate of the current source field effect transistor, characterized in that the gate of the first field effect transistor is connected to said junction point, in that the gate of the second field effect transistor is connected to the first supply voltage terminal, and in that channel width/channel length ratios $k_1$ and $k_2$ and of the first and second field effect transistors respectively and threshold voltages $V_{TD}$ thereof are chosen to be such that, at the desired current supplied by the current source, the temperature-dependent variation of the gate-source voltage of the first transistor, at least within a selected temperature range, substantially corresponds to the temperature-dependent variation required of the source-gate voltage of the current source field effect transistor for the output current thereof to be maintained substantially constant.

7. A circuit arrangement as claimed in claim 5, characterized in that the channel width/channel length ratios $k_1$ and $k_2$ of the first and second transistors, respectively, and the threshold voltages $V_{TD}$ thereof, as well as the threshold voltage $V_{TE}$ of the current source field effect transistor are chosen to be such that at a given reference temperature $T_0$ the following equation is at least substantially satisfied:

$$\frac{(k_1k_2) - \sqrt{k_1(k_1 + 3k_2)}}{k_2 - k_1} = \frac{V_{TE}(T_0) + \frac{4}{3}\left|\frac{dV_{TE}}{dT}\right| \cdot T_0}{|V_{TD}(T_0)| - \frac{4}{3}\left|\frac{dV_{TD}}{dT}\right| \cdot T_0}.$$

8. A circuit arrangement as claimed in claim 5 or 6, characterized in that the channel width/channel length ratio of the second field effect transistor relative to the channel width/channel length ratio of the first field effect transistor is chosen to be relatively large.

9. A circuit arrangement as claimed in claim 5 or 7, further comprising a fourth depletion mode field effect transistor having a channel and a gate, characterized in that the channel of said fourth depletion mode field effect transistor operated in the saturated mode is coupled between the second supply voltage terminal and the channel of the second transistor, the gate of said fourth field effect transistor being connected to said junction point.

* * * * *